US007503403B2

(12) United States Patent
Jogi et al.

(10) Patent No.: US 7,503,403 B2
(45) Date of Patent: Mar. 17, 2009

(54) METHOD AND APPARATUS FOR ENHANCING DIRECTIONAL ACCURACY AND CONTROL USING BOTTOMHOLE ASSEMBLY BENDING MEASUREMENTS

(75) Inventors: Pushkar Jogi, Houston, TX (US); Michael Neubert, Braunschweig (DE); John D. MacPherson, Sugar Land, TX (US); James Hood, Houston, TX (US); Thomas Dahl, Schwuelper (DE); Volker Krueger, Celle (DE); Andrew G. Brooks, Tomball, TX (US); Gerald Heisig, Braunschweig (DE)

(73) Assignee: Baker Hughes, Incorporated, Houston, TX (US)

( * ) Notice: Subject to any disclaimer, the term of this patent is extended or adjusted under 35 U.S.C. 154(b) by 288 days.

(21) Appl. No.: 11/016,417

(22) Filed: Dec. 17, 2004

(65) Prior Publication Data

US 2005/0150689 A1 Jul. 14, 2005

Related U.S. Application Data

(60) Provisional application No. 60/531,392, filed on Dec. 19, 2003.

(51) Int. Cl.
*E21B 47/02* (2006.01)

(52) U.S. Cl. ..... 175/45; 175/61

(58) Field of Classification Search ..... 175/45, 175/61

See application file for complete search history.

(56) References Cited

U.S. PATENT DOCUMENTS 2,930,137 A * 3/1960 Arps ..... 33/312
4,662,458 A 5/1987 Ho
4,739,841 A * 4/1988 Das ..... 175/61
4,747,303 A 5/1988 Fontenot
5,001,675 A 3/1991 Woodward
5,083,124 A 1/1992 Nordstrom
5,126,564 A 6/1992 Perry et al.
5,134,285 A 7/1992 Perry et al.
5,144,126 A 9/1992 Perry et al.
5,160,925 A 11/1992 Dailey et al.
5,325,714 A 7/1994 Lende et al.

(Continued)

OTHER PUBLICATIONS

Hood et al., "Real-Time BHA Bending Information Reduces Risk When Drilling Hard Interbedded Formations", SPE/IADC 79918, 2003, pp. 1-12.

*Primary Examiner*—Shane Bomar
(74) *Attorney, Agent, or Firm*—Madan Mossman & Sriram PC

(57) ABSTRACT

A system for drilling a well comprises a tubular member having a bottomhole assembly at a bottom end thereof disposed in a wellbore. A first sensor is disposed in the bottomhole assembly at a predetermined axial location for detecting bending in a first axis and generating a first bending signal in response thereto, where the first axis is substantially orthogonal to a longitudinal axis of the bottomhole assembly. A second sensor is disposed in the bottomhole assembly at the predetermined axial location for detecting bending in a second axis and generating a second bending signal in response thereto, where the second axis is substantially orthogonal to the longitudinal axis. A processor receives the first bending signal and the second bending signal and relates the first bending signal and the second bending signal to a borehole curvature according to programmed instructions.

21 Claims, 12 Drawing Sheets

U.S. PATENT DOCUMENTS 5,456,106 A 10/1995 Harvey et al.
5,465,799 A * 11/1995 Ho ..... 175/61
5,608,162 A * 3/1997 Ho ..... 73/152.48
6,021,377 A 2/2000 Dubinsky et al.
6,057,784 A 5/2000 Schaaf et al.
6,216,533 B1 4/2001 Woloson et al.
6,438,495 B1 * 8/2002 Chau et al. ..... 702/9
6,547,016 B2 4/2003 Wassell

* cited by examiner

METHOD AND APPARATUS FOR ENHANCING DIRECTIONAL ACCURACY AND CONTROL USING BOTTOMHOLE ASSEMBLY BENDING MEASUREMENTS

CROSS REFERENCE TO RELATED APPLICATIONS

This application claims the benefit of U.S. Provisional Application No. 60/531,392, filed Dec. 19, 2003.

FIELD OF THE INVENTION

This invention generally relates to logging while drilling. More specifically this invention relates to a method, system, and apparatus for predicting curvature of a wellbore form bending moment measurements and for adjusting downhole steerable systems based on such measurements.

BACKGROUND OF THE INVENTION

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations. Modem directional drilling systems generally employ a drill string having a bottomhole assembly (BHA) and a drill bit at end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity measuring device to determine the presence of hydrocarbons and water. Additional downhole instruments, known as logging-while-drilling ("LWD") tools, are frequently attached to the drill string to determine the formation geology and formation fluid conditions during the drilling operations.

Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a motor, to facilitate directional drilling and to drill vertical boreholes. The drill bit is typically coupled to a bearing assembly having a drive shaft which in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed (r.p.m of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation.

Additionally, various downhole sensors and associated electronic circuitry deployed in the BHA continually provide information to the operator about certain downhole operating conditions, condition of various elements of the drill string and information about the formation through which the borehole is being drilled.

Typically, the information provided to the operator during drilling includes: (a) borehole pressure and temperature; (b) drilling parameters, such as WOB, rotational speed of the drill bit and/ or the drill string, and the drilling fluid flow rate. In some cases, the drilling operator also is provided selected information about the bottomhole assembly condition (parameters), such as torque, mud motor differential pressure, bit bounce and whirl etc.

The downhole sensor data is typically processed downhole to some extent and telemetered uphole by electromagnetic signal transmission devices or by transmitting pressure pulses through the circulating drilling fluid. Mud-pulse telemetry, however, is more commonly used. Such a system is capable of transmitting only a few (1-4) bits of information per second.

The BHA in a directional wellbore is subjected to bending moments due to side forces acting on the BHA. These side forces can be caused by gravity, drilling dynamic effects, and/or by contact between the borehole wall and the BHA. These bending moments cause deviations from the desired wellbore path that require corrections. In common directional systems, including MWD systems, a directional survey of azimuth and inclination is taken by sensors in the BHA after the drilling of each stand of drill pipe. The measurements allow the determination of a pointing vector having an inclination and direction, also called azimuth, associated with the BRA at each survey location. The difference in the three dimensional angle of the pointing vectors at successive survey stations divided by the path length between stations can be used as a measure of the irregularity of the borehole curvature known as dogleg severity. Common systems measures bending moment and transmit the values to the surface to determine the side forces and stresses in the BHA for a given borehole curvature determined from measured survey data. Commonly, high dogleg severity can cause difficulty in further drilling and/or installing production casing and other downhole equipment. The nature of taking measurements only after each stand exacerbates the problem.

There is a need for a system and method for taking substantially continuous bending measurements that can be used to provide substantially continuous borehole curvature estimates leading to improved borehole quality.

SUMMARY OF THE INVENTION

In one aspect, the present invention provides method for drilling a well, comprising extending a tubular member having a bottomhole assembly at a bottom end thereof into a wellbore. Bending of the bottomhole assembly is measured at a predetermined axial location along the bottomhole assembly. A borehole curvature is estimated from the measured bending.

In another aspect, a system for drilling a well comprises a tubular member having a bottomhole assembly at a bottom end thereof disposed in a wellbore. A first sensor is disposed in the bottomhole assembly at a predetermined axial location for detecting bending in a first axis and generating a first bending signal in response thereto, where the first axis is substantially orthogonal to a longitudinal axis of the bottomhole assembly. A second sensor is disposed in the bottomhole assembly at the predetermined axial location for detecting bending in a second axis and generating a second bending signal in response thereto, where the second axis is substantially orthogonal to the longitudinal axis. A processor receiving the first bending signal and the second bending signal and relating the first bending signal and the second bending signal to a borehole curvature according to programmed instructions.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention, wherein.

DESCRIPTION OF THE PREFERRED EMBODIMENTS

Figure 1:
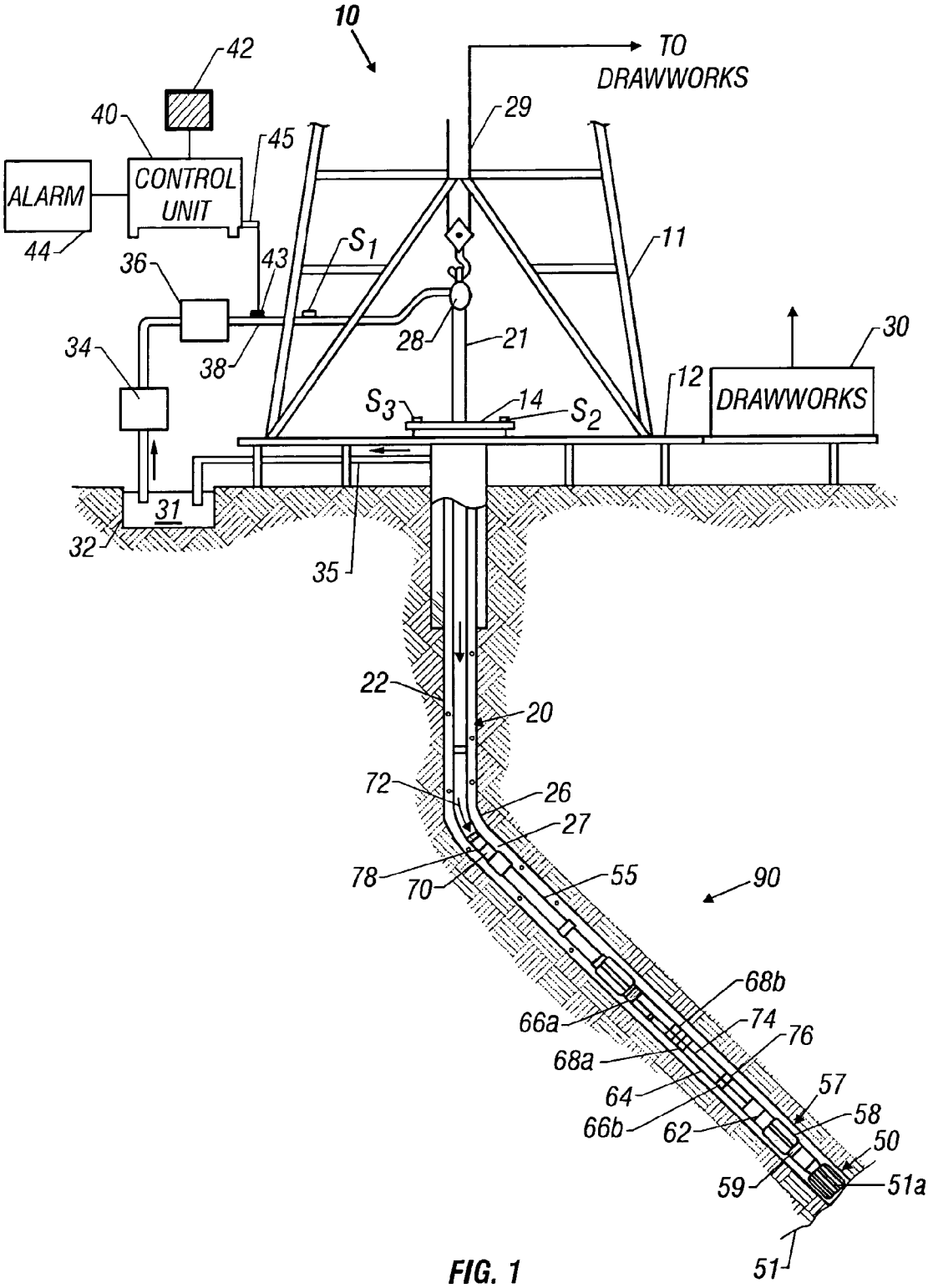
FIG. 1 shows a schematic diagram of a drilling system having a drill string containing a drill bit, mud motor, direction-determining devices, measurement-while-drilling devices and a downhole telemetry system according to the present invention.

FIG. 1 shows a schematic diagram of a drilling system 10 having a drilling assembly 90 shown conveyed in a borehole 26 for drilling the wellbore. The drilling system 10 includes a conventional derrick 11 erected on a floor 12 which supports a rotary table 14 that is rotated by a prime mover such as an electric motor (not shown) at a desired rotational speed. The drill string 20 includes a drill pipe 22 extending downward from the rotary table 14 into the borehole 26. A drill bit 50, attached to the drill string end, disintegrates the geological formations when it is rotated to drill the borehole 26. The drill string 20 is coupled to a drawworks 30 via a kelly joint 21, swivel 28 and line 29 through a pulley 23. During the drilling operation the drawworks 30 is operated to control the weight on bit, which is an important parameter that affects the rate of penetration. The operation of the drawworks 30 is well known in the art and is thus not described in detail herein.

During drilling operations a suitable drilling fluid 31 from a mud pit (source) 32 is circulated under pressure through the drill string 20 by a mud pump 34. The drilling fluid 31 passes from the mud pump 34 into the drill string 20 via a desurger 36, fluid line 38 and the kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, a sensor (not shown) associated with line 29 is used to provide the hook load of the drill string 20.

In some applications the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. In either case, the rate of penetration (ROP) of the drill bit 50 into the borehole 26 for a given formation and a drilling assembly largely depends upon the weight on bit and the drill bit rotational speed.

In one embodiment of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the drill motor and the reactive upward loading from the applied weight on bit. A stabilizer 58 coupled to the bearing assembly 57 acts as a centralizer for the lowermost portion of the mud motor assembly.

A surface control unit 40 receives signals from the downhole sensors and devices via a sensor 43 placed in the fluid line 38 and signals from sensors S1, S2, S3, hook load sensor and any other sensors used in the system and processes such signals according to programmed instructions provided to the surface control unit 40. The surface control unit 40 displays desired drilling parameters and other information on a display/monitor 42 and is utilized by an operator to control the drilling operations. The surface control unit 40 contains a computer, memory for storing data, recorder for recording data and other peripherals. The surface control unit 40 also includes a simulation model and processes data according to programmed instructions and responds to user commands entered through a suitable device, such as a keyboard. The control unit 40 is adapted to activate alarms 44 when certain unsafe or undesirable operating conditions occur. The use of the simulation model is described in detail later.

In one embodiment of the drilling assembly 90, The BHA contains a DDM device 59 in the form of a module or detachable subassembly placed near the drill bit 50. The DDM device 59 contains sensors, circuitry and processing software and algorithms for providing information about desired dynamic drilling parameters relating to the BHA. Such parameters may include bit bounce, stick-slip of the BHA, backward rotation, torque, shocks, BHA whirl, BHA buckling, borehole and annulus pressure anomalies and excessive acceleration or stress, and may include other parameters such as BHA and drill bit side forces, and drill motor and drill bit conditions and efficiencies. The DDM device 59 processes the sensor signals to determine the relative value or severity of each such parameter and transmits such information to the surface control unit 40 via a suitable telemetry system 72. The processing of signals and data generated by the sensors in the module 59 is described later in reference to FIG. 5. Drill bit 50 may contain sensors 50*a* for determining drill bit condition and wear.

Referring back to FIG. 1, the BHA may also contain sensors and devices in addition to the above-described sensors. Such devices include a device for measuring the formation resistivity near and/or in front of the drill bit, a gamma ray device for measuring the formation gamma ray intensity and devices for determining the inclination and azimuth of the drill string.

The formation resistivity measuring device 64 is coupled above the lower kick-off subassembly 62 that provides signals from which resistivity of the formation near or in front of the drill bit 50 is determined. One resistivity measuring device is described in U.S. Pat. No. 5,001,675, which is assigned to the assignee hereof and is incorporated herein by reference. This patent describes a dual propagation resistivity device ("DPR") having one or more pairs of transmitting antennae 66*a* and 66*b* spaced from one or more pairs of receiving antennae 68*a* and 68*b*. Magnetic dipoles are employed which operate in the medium frequency and lower high frequency spectrum. In operation, the transmitted electromagnetic waves are perturbed as they propagate through the formation surrounding the resistivity device 64. The receiving antennas 68*a* and 68*b* detect the perturbed waves. Formation resistivity is derived from the phase and amplitude of the detected signals. The detected signals are processed by a downhole circuit that is placed in a housing 70 above the mud motor 55 and transmitted to the surface control unit 40 using a suitable telemetry system 72.

The inclinometer 74 and gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, an azimuth device (not shown), such as a magnetometer or a gyroscopic device, may be utilized to determine the drill string azimuth. Such devices are known in the art and therefore are not described in detail herein. In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place.

U.S. Pat. No. 5,325,714, assigned to the assignee hereof, which is incorporated herein by reference, discloses placement of a resistivity device between the drill bit 50 and the mud motor 55. The above described resistivity device, gamma ray device and the inclinometer may be placed in a common housing that may be coupled to the motor in the manner described in U.S. Pat. No. 5,325,714. Additionally, U.S. Pat. No. 5,456,106, assigned to the assignee hereof, which is incorporated herein by reference, discloses a modular system wherein the drill string contains modular assemblies including a modular sensor assembly, motor assembly and kick-off subs. The modular sensor assembly is disposed between the drill bit and the mud motor as described herein above. In one embodiment, the present invention utilizes the modular system as disclosed in U.S. Pat. No. 5,456,106.

Still referring to FIG. 1, logging-while-drilling devices, such as devices for measuring formation porosity, permeability and density, may be placed above the mud motor 64 in the housing 78 for providing information useful for evaluating and testing subsurface formations along borehole 26. U.S. Pat. No. 5,134,285, which is assigned to the assignee hereof, which is incorporated herein by reference, discloses a formation density device that employs a gamma ray source and a detector. In use, gamma rays emitted from the source enter the formation where they interact with the formation and attenuate. The attenuation of the gamma rays is measured by a suitable detector from which density of the formation is determined.

The present system utilizes a formation porosity measurement device, such as that disclosed in U.S. Pat. No. 5,144,126 which is assigned to the assignee hereof and which is incorporated herein by reference, which employs a neutron emission source and a detector for measuring the resulting gamma rays. In use, high energy neutrons are emitted into the surrounding formation. A suitable detector measures the neutron energy delay due to interaction with hydrogen atoms present in the formation. Other examples of nuclear logging devices are disclosed in U.S. Pat. Nos. 5,126,564 and 5,083,124.

The above-noted devices transmit data to the downhole telemetry system 72, which in turn transmits the received data uphole to the surface control unit 40. The downhole telemetry system 72 also receives signals and data from the uphole control unit 40 and transmits such received signals and data to the appropriate downhole devices. The present invention utilizes a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Other telemetry techniques, such as electromagnetic and acoustic techniques or any other suitable technique, may be utilized for the purposes of this invention.

The drilling system described thus far relates to those drilling systems that utilize a drill pipe to conveying the drilling assembly 90 into the borehole 26, wherein the weight on bit, one of the important drilling parameters, is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the required to force on the drill bit. For the purpose of this invention, the term weight on bit is used to denote the force on the bit applied to the drill bit during drilling operation, whether applied by adjusting the weight of the drill string or by thrusters or by any other method. Also, when coiled-tubing is utilized the tubing is not rotated by a rotary table, instead it is injected into the wellbore by a suitable injector while the downhole motor, such as mud motor 55, rotates the drill bit 50.

A number of sensors are also placed in the various individual devices in the drilling assembly. For example, a variety of sensors are placed in the mud motor, bearing assembly, drill shaft, tubing and drill bit to determine the condition of such elements during drilling and the borehole parameters.

One manner of deploying certain sensors in the various drill string elements will now be described.

Figure 2A:
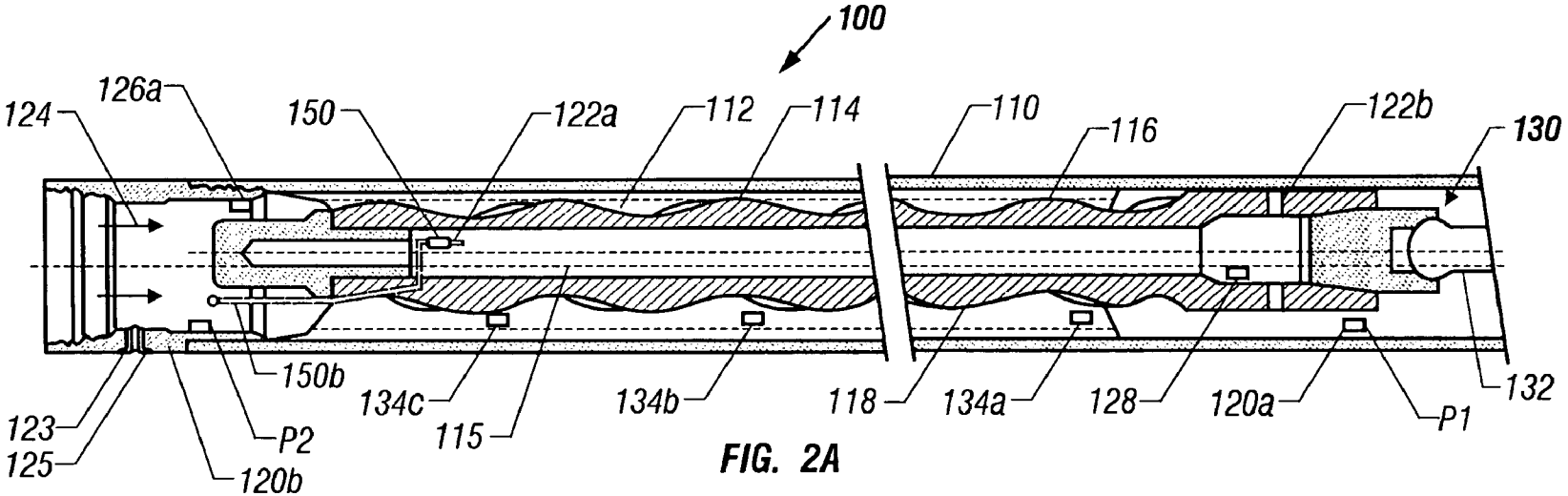
FIGS. 2*a*-2*b* show a longitudinal cross-section of a motor assembly having a mud motor and a non-sealed or mud-lubricated bearing assembly and one manner of placing certain sensors in the motor assembly for continually measuring certain motor assembly operating parameters according to the present invention.
Figure 2B:
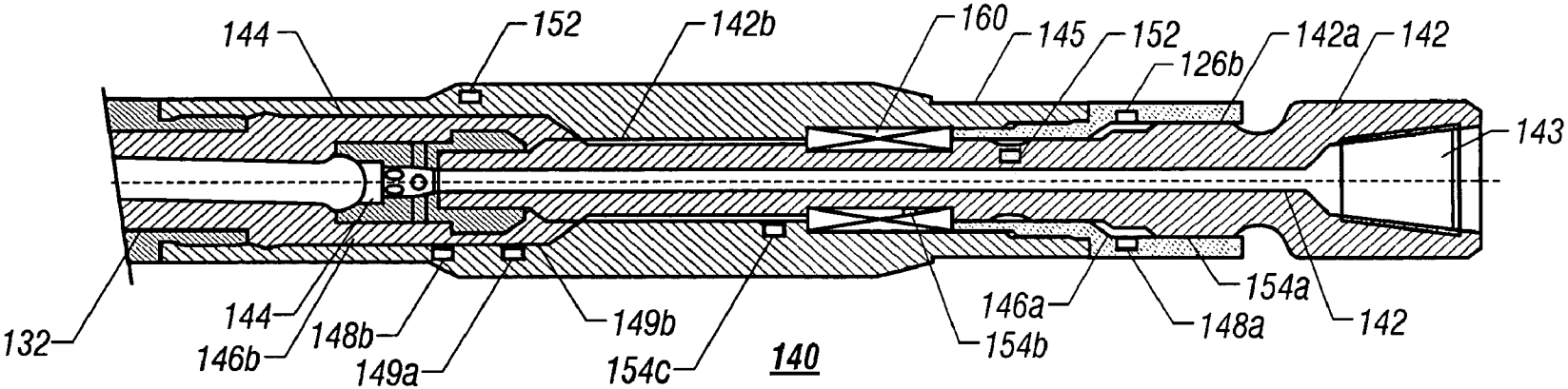

One method of mounting various sensors for determining the motor assembly parameters and the method for controlling the drilling operations in response to such parameters will now be described in detail while referring to FIGS. 2*a*-4. FIGS. 2*a*-2*b* show a cross-sectional elevation view of a positive displacement mud motor power section 100 coupled to a mud-lubricated bearing assembly 140 for use in the drilling system 10. The power section 100 contains an elongated housing 110 having therein a hollow elastomeric stator 112 which has a helically-lobed inner surface 114. A metal rotor 116, that may be made from steel, having a helically-lobed outer surface 118 is rotatably disposed inside the stator 112. The rotor 116 may have a non-through bore 115 that terminates at a point 122*a* below the upper end of the rotor as shown in FIG. 2*a*. The bore 115 remains in fluid communication with the fluid below the rotor via a port 122*b*. Both the rotor and stator lobe profiles are similar, with the rotor having one less lobe than the stator. The rotor and stator lobes and their helix angles are such that rotor and stator seal at discrete intervals resulting in the creation of axial fluid chambers or cavities which are filled by the pressurized drilling fluid.

The action of the pressurized circulating fluid flowing from the top to bottom of the motor, as shown by arrows 124, causes the rotor 116 to rotate within the stator 112. Modification of lobe numbers and geometry provides for variation of motor input and output characteristics to accommodate different drilling operations requirements.

Still referring to FIGS. 2*a*-2*b*, a differential pressure sensor 150 disposed in line 115 senses at its one end pressure of the fluid 124 before it passes through the mud motor via a fluid line 150*a* and at its other end the pressure in the line 115, which is the same as the pressure of the drilling fluid after it has passed around the rotor 116. The differential pressure sensor thus provides signals representative of the pressure differential across the rotor 116. Alternatively, a pair of pressure sensors P1 and P2 may be disposed a fixed distance apart, one near the bottom of the rotor at a suitable point 120*a* and the other near the top of the rotor at a suitable point 120*b*. Another differential pressure sensor 122 (or a pair of pressure sensors) may be placed in an opening 123 made in the housing 110 to determine the pressure differential between the fluid 124 flowing through the motor 110 and the fluid flowing through the annulus 27 (see FIG. 1) between the drill string and the borehole.

To measure the rotational speed of the rotor downhole and thus the drill bit 50, a suitable sensor 126*a* is coupled to the power section 100. A vibration sensor, magnetic sensor, Hall-effect sensor or any other suitable sensor may be utilized for determining the motor speed. Alternatively, a sensor 126*b* may be placed in the bearing assembly 140 for monitoring the rotational speed of the motor (see FIG. 2*b*). A sensor 128 for measuring the rotor torque is placed at the rotor bottom. In addition, one or more temperature sensors may be suitably disposed in the power section 100 to continually monitor the temperature of the stator 112. High temperatures may result due to the presence of high friction of the moving parts. High stator temperature can deteriorate the elastomeric stator and thus reduce the operating life of the mud motor. In FIG. 2*a* three spaced temperature sensors 134*a*-*c* are shown disposed in the stator 112 for monitoring the stator temperature.

Each of the above-described sensors generates signals representative of its corresponding mud motor parameter, which signals are transmitted to the downhole control circuit placed in section 70 of the drill string 20 via hard wires coupled between the sensors and the control circuit or by magnetic or acoustic coupling devices known in the art or by any other desirable manner for further processing of such signals and the transmission of the processed signals and data uphole via the downhole telemetry. U.S. Pat. No. 5,160,925, assigned to the assignee hereof, which is incorporated herein by reference, discloses a modular communication link placed in the drill string for receiving data from the various sensors and devices and transmitting such data upstream. The system of the present invention may also utilize such a communication link for transmitting sensor data to the control circuit or the surface control system.

The mud motor's rotary force is transferred to the bearing assembly 140 via a rotating shaft 132 coupled to the rotor 116. The shaft 132 disposed in a housing 130 eliminates all rotor eccentric motions and the effects of fixed or bent adjustable housings while transmitting torque and downthrust to the drive sub 142 of the bearing assembly 140. The type of the bearing assembly used depends upon the particular application. However, two types of bearing assemblies are most commonly used in the industry: a mud-lubricated bearing assembly such as the bearing assembly 140 shown in FIG. 2*a*, and a sealed bearing assembly, such as bearing assembly 170 shown in FIG. 2*c*.

Referring back to FIG. 2*b*, a mud-lubricated bearing assembly typically contains a rotating drive shaft 142 disposed within an outer housing 145. The drive shaft 142 terminates with a bit box 143 at the lower end that accommodates the drill bit 50 (see FIG. 1) and is coupled to the shaft 132 at the upper end 144 by a suitable joint 144'. The drilling fluid from the power section 100 flows to the bit box 143 via a through hole 142' in the drive shaft 142. The radial movement of the drive shaft 142 is restricted by a suitable lower radial bearing 142*a* placed at the interior of the housing 145 near its bottom end and an upper radial bearing 142*b* placed at the interior of the housing near its upper end. Narrow gaps or clearances 146*a* and 146*b* are respectively provided between the housing 145 and the vicinity of the lower radial bearing 142*a* and the upper radial bearing 142*b* and the interior of the housing 145. The radial clearance between the drive shaft and the housing interior varies approximately between 0.150 mm to 0.300 mm depending upon the design choice.

During the drilling operations, the radial bearings, such as shown in FIG. 2*b*, start to wear down causing the clearance to vary. Depending upon the design requirement, the radial bearing wear can cause the drive shaft to wobble, making it difficult for the drill string to remain on the desired course and in some cases can cause the various parts of the bearing assembly to become dislodged. Since the lower radial bearing 142*a* is near the drill bit, even a relatively small increase in the clearance at the lower end can reduce the drilling efficiency. To continually measure the clearance between the drive shaft 142 and the housing interior, displacement sensors 148*a* and 148*b* are respectively placed at suitable locations on the housing interior. The sensors are positioned to measure the movement of the drive shaft 142 relative to the inside of the housing 145. Signals from the displacement sensors 148*a* and 148*b* may be transmitted to the downhole control circuit by conductors placed along the housing interior (not shown) or by any other manner described above in reference to FIGS. 2*a*.

Still referring to FIG. 2*b*, a thrust bearing section 160 is provided between the upper and lower radial bearings to control the axial movement of the drive shaft 142. The thrust bearings 160 support the downthrust of the rotor 116, downthrust due to fluid pressure drop across the bearing assembly 140 and the reactive upward loading from the applied weight on bit. The drive shaft 142 transfers both the axial and torsional loading to the drill bit coupled to the bit box 143. If the clearance between the housing and the drive shaft has an inclining gap, such as shown by numeral 149, then the same displacement sensor 149*a* may be used to determine both the radial and axial movements of the drive shaft 142. Alternatively, a displacement sensor may be placed at any other suitable place to measure the axial movement of the drive shaft 142. High precision displacement sensors suitable for use in borehole drilling are commercially available and, thus, their operation is not described in detail. From the discussion thus far, it should be obvious that weight on bit is an important control parameter for drilling boreholes. A load sensor 152, such as a strain gauge, is placed at a suitable place in the bearing assembly 142 (downstream of the thrust bearings 160) to continuously measure the weight on bit.

Alternatively, a sensor 152' may be placed in the bearing assembly housing 145 (upstream of the thrust bearings 160) or in the stator housing 110 (see FIG. 2*a*) to monitor the weight on bit.

Figure 2C:
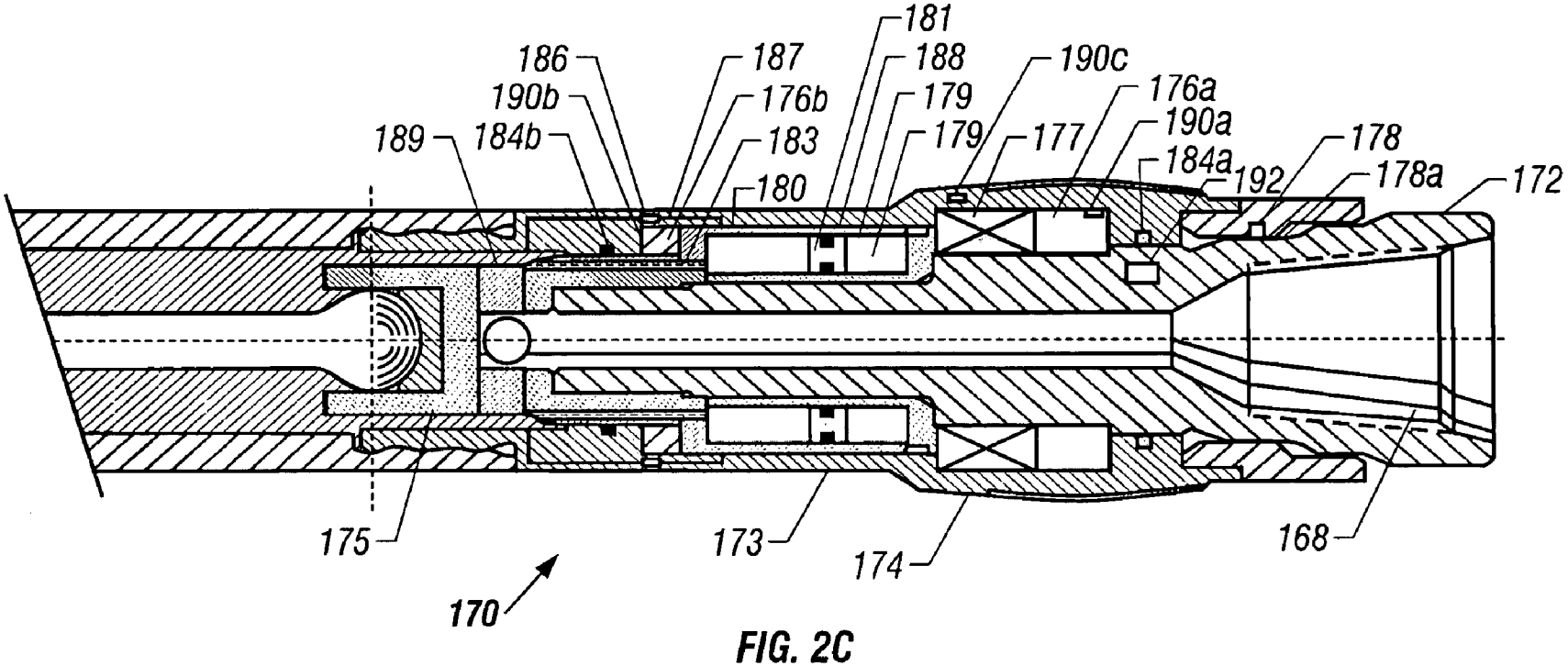
FIG. 2*c* shows a longitudinal cross-section of a sealed bearing assembly and one manner of the placement of certain sensors thereon for use with the mud motor shown in FIG. 2*a;*

Sealed bearing assemblies are typically utilized for precision drilling and have much tighter tolerances compared to the mud-lubricated bearing assemblies. FIG. 2*c* shows a sealed bearing assembly 170, which contains a drive shaft 172 disposed in a housing 173. The drive shaft is coupled to the motor shaft via a suitable universal joint 175 at the upper end and has a bit box 168 at the bottom end for accommodating a drill bit. Lower and upper radial bearings 176*a* and 176*b* provide radial support to the drive shaft 172 while a thrust bearing 177 provides axial support. One or more suitably placed displacement sensors may be utilized to measure the radial and axial displacements of the drive shaft 172. For simplicity and not as a limitation, in FIG. 2*c* only one displacement sensor 178 is shown to measure the drive shaft radial displacement by measuring the amount of clearance 178*a*.

As noted above, sealed-bearing-type drive subs have much tighter tolerances (as low as 0.001" radial clearance between the drive shaft and the outer housing) and the radial and thrust bearings are continuously lubricated by a suitable working oil 179 placed in a cylinder 180. Lower and upper seals 184*a* and 184*b* are provided to prevent leakage of the oil during the drilling operations. However, due to the hostile downhole conditions and the wearing of various components, the oil frequently leaks, thus depleting the reservoir 180, thereby causing bearing failures. To monitor the oil level, a differential pressure sensor 186 is placed in a line 187 coupled between an oil line 188 and the drilling fluid 189 to provide the difference in the pressure between the oil pressure and the drilling fluid pressure. Since the differential pressure for a new bearing assembly is known, reduction in the differential pressure during the drilling operation may be used to determine the amount of the oil remaining in the reservoir 180. Additionally, temperature sensors 190*a-c* may be placed in the bearing assembly sub 170 to respectively determine the temperatures of the lower and upper radial bearings 176*a-b* and thrust bearings 177. Also, a pressure sensor 192 is placed in the fluid line in the drive shaft 172 for determining the weight on bit. Signals from the differential pressure sensor 186, temperature sensors 190*a-c*, pressure sensor 192 and displacement sensor 178 are transmitted to the downhole control circuit in the manner described earlier in relation to FIG. 2*a*.

Figure 3:
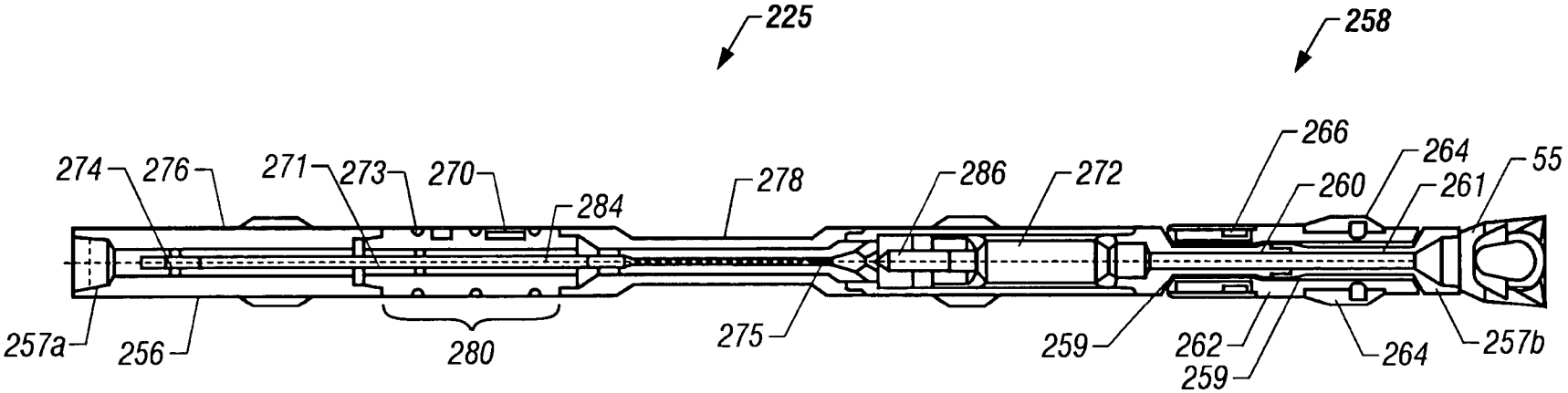
FIG. 3 shows a schematic diagram of a drilling assembly for use with a surface rotary system for drilling boreholes, wherein the drilling assembly has a non-rotating collar for effecting directional changes downhole.

FIG. 3 shows a schematic diagram of a rotary drilling assembly 255 conveyable downhole by a drill pipe (not shown) that includes a device for changing drilling direction without stopping the drilling operations for use in the drilling system 10 shown in FIG. 1. The drilling assembly 255 has an outer housing 256 with an upper joint 257*a* for connection to the drill pipe (not shown) and a lower joint 257*b* for accommodating a drill bit 55. During drilling operations the housing, and thus the drill bit 55, rotate when the drill pipe is rotated by the rotary table at the surface. The lower end 258 of the housing 256 has reduced outer dimensions 258 and a bore 259 therethrough. The reduced-dimensioned end 258 has a shaft 260 that is connected to the lower end 257*b* and a passage 261 for allowing the drilling fluid to pass to the drill bit 55. A non-rotating sleeve 262 is disposed on the outside of the reduced dimensioned end 258, in that when the housing 256 is rotated to rotate the drill bit 55, the non-rotating sleeve 262 remains in its position. A plurality of independently adjustable or expandable stabilizers 264 are disposed on the outside of the non-rotating sleeve 262. Each stabilizer 264 is hydraulically operated by a control unit in the drilling assembly 255. By selectively extending or retracting the individual stabilizers 264 during the drilling operations, the drilling direction can be substantially continuously and relatively accurately controlled. An inclination device 266, such as one or more magnetometers and gyroscopes, are disposed on the non-rotating sleeve 262 for determining the inclination of the sleeve 262. A gamma ray device 270 and any other device may be utilized to determine the drill bit position during drilling, for example in the x, y, and z axis of the drill bit 55. An alternator and oil pump 272 may be disposed uphole of the sleeve 262 for providing hydraulic power and electrical power to the various downhole components, including the stabilizers 264. Batteries 274 for storing and providing electric power downhole are disposed at one or more suitable places in the drilling assembly 255.

The drilling assembly 255, like the drilling assembly 90 shown in FIG. 1, may include any number of devices and sensors to perform other functions and provide the required data about the various types of parameters relating to the drilling system described herein. The drilling assembly 255 includes a resistivity device for determining the resistivity of the formations surrounding the drilling assembly, other formation evaluation devices, such as porosity and density devices (not shown), a directional sensor 271 near the upper end 257*a* and sensors for determining the temperature, pressure, fluid flow rate, weight on bit, rotational speed of the drill bit, radial and axial vibrations, shock, and whirl. The drilling assembly may also include position sensitive sensors for determining the drill string position relative to the borehole walls. Such sensors may be selected from a group comprising acoustic stand off sensors, calipers, electromagnetic, and nuclear sensors.

The drilling assembly 255 includes a number of non-magnetic stabilizers 276 near the upper end 257*a* for providing lateral or radial stability to the drill string during drilling operations. A flexible joint 278 is disposed between the section 280 containing the various above-noted formation evaluation devices and the non-rotating sleeve 262. The drilling assembly 256 which includes a control unit or circuits having one or more processors, generally designated herein by numeral 284, processes the signals and data from the various downhole sensors. Typically, the formation evaluation devices include dedicated electronics and processors as the data processing need during the drilling can be relatively extensive for each such device. Other desired electronic circuits are also included in the section 280. The processing of signals is performed generally in the manner described below in reference to FIG. 4. A telemetry device, in the form of an electromagnetic device, an acoustic device, a mud-pulse device or any other suitable device, generally designated herein by numeral 286 is disposed in the drilling assembly 255 at a suitable place.

Figure 4:
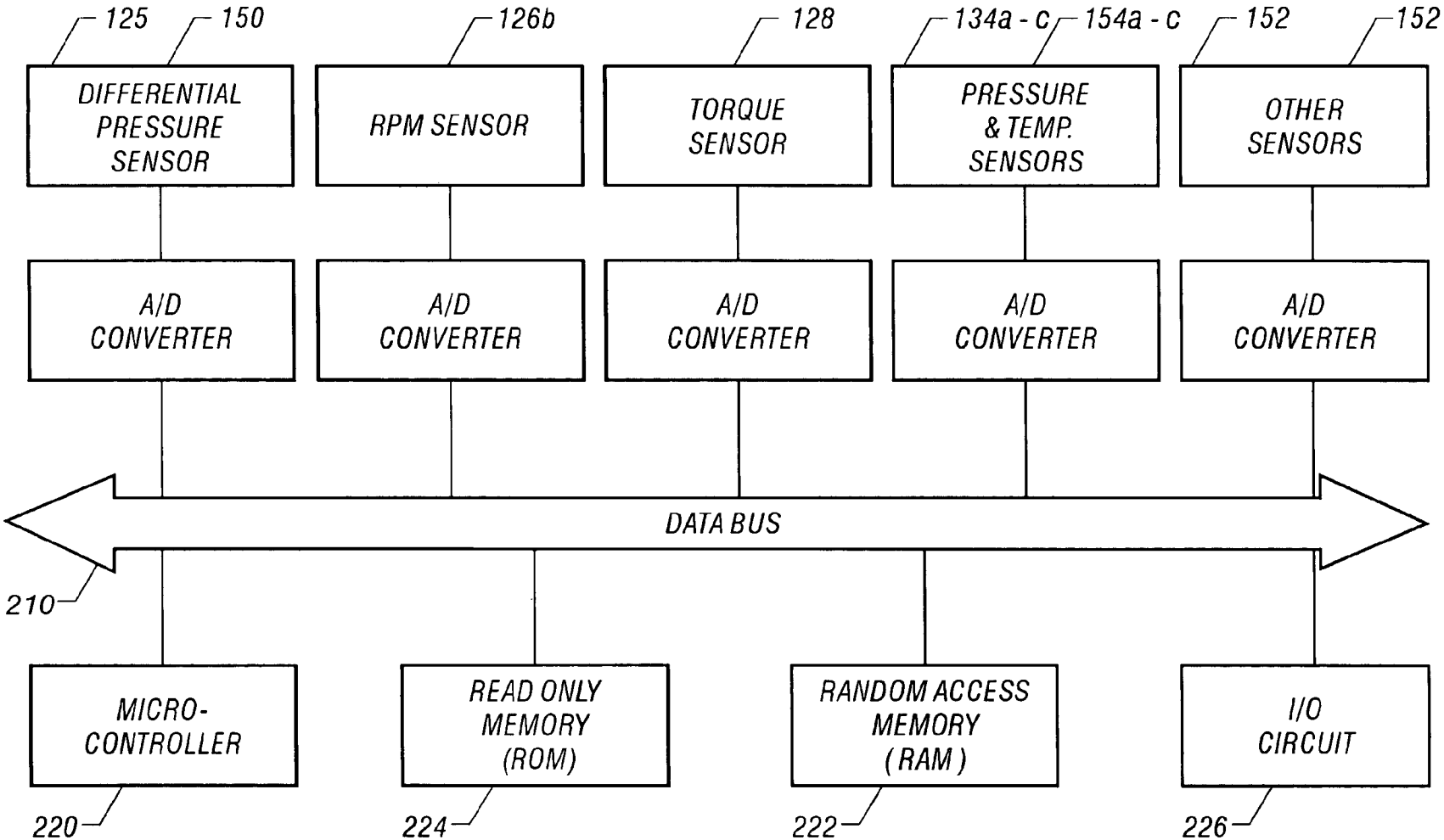
FIG. 4 shows a block circuit diagram for processing signals relating to certain downhole sensor signals for use in the bottom hole assembly used in the drilling system shown in FIG. 1.

FIG. 4 shows a block circuit diagram of a portion of an exemplary circuit that may be utilized to perform signal processing, data analysis and communication operations relating to the motor sensor and other drill string sensor signals. The differential pressure sensors 125 and 150, sensor pair P1 and P2, RPM sensor 126*b*, torque sensor 128, temperature sensors 134*a-c* and 154*a-c*, drill bit sensors 50*a*, WOB sensor 152 or 152' and other sensors utilized in the drill string 20, provide analog signals representative of the parameter measured by such sensors. The analog signals from each such sensor are amplified and passed to an associated analog-to-digital (A/D) converter which provides a digital output corresponding to its respective input signal. The digitized sensor data is passed to a data bus 210. A micro-controller 220 coupled to the data bus 210 processes the sensor data downhole according to programmed instruction stored in a read only memory (ROM) 224 coupled to the data bus 210. A random access memory (RAM) 222 coupled to the data bus 210 is utilized by the micro-controller 220 for downhole storage of the processed data. The micro-controller 220 communicates with other downhole circuits via an input/output (I/O) circuit 226 (telemetry). The processed data is sent to the surface control unit 40 (see FIG. 1) via the downhole telemetry 72. For example, the micro-controller can analyze motor operation downhole, including stall, underspeed and overspeed conditions as may occur in two-phase underbalance drilling and communicate such conditions to the surface unit via the telemetry system. The micro-controller 220 may be programmed to (a) record the sensor data in the memory 222 and facilitate communication of the data uphole, (b) perform analyses of the sensor data to compute answers and detect adverse conditions, (c) actuate downhole devices to take corrective actions, (d) communicate information to the surface, (f) transmit command and/or alarm signals uphole to cause the surface control unit 40 to take certain actions, (g) provide to the drilling operator information for the operator to take appropriate actions to control the drilling operations.

Figure 5A:
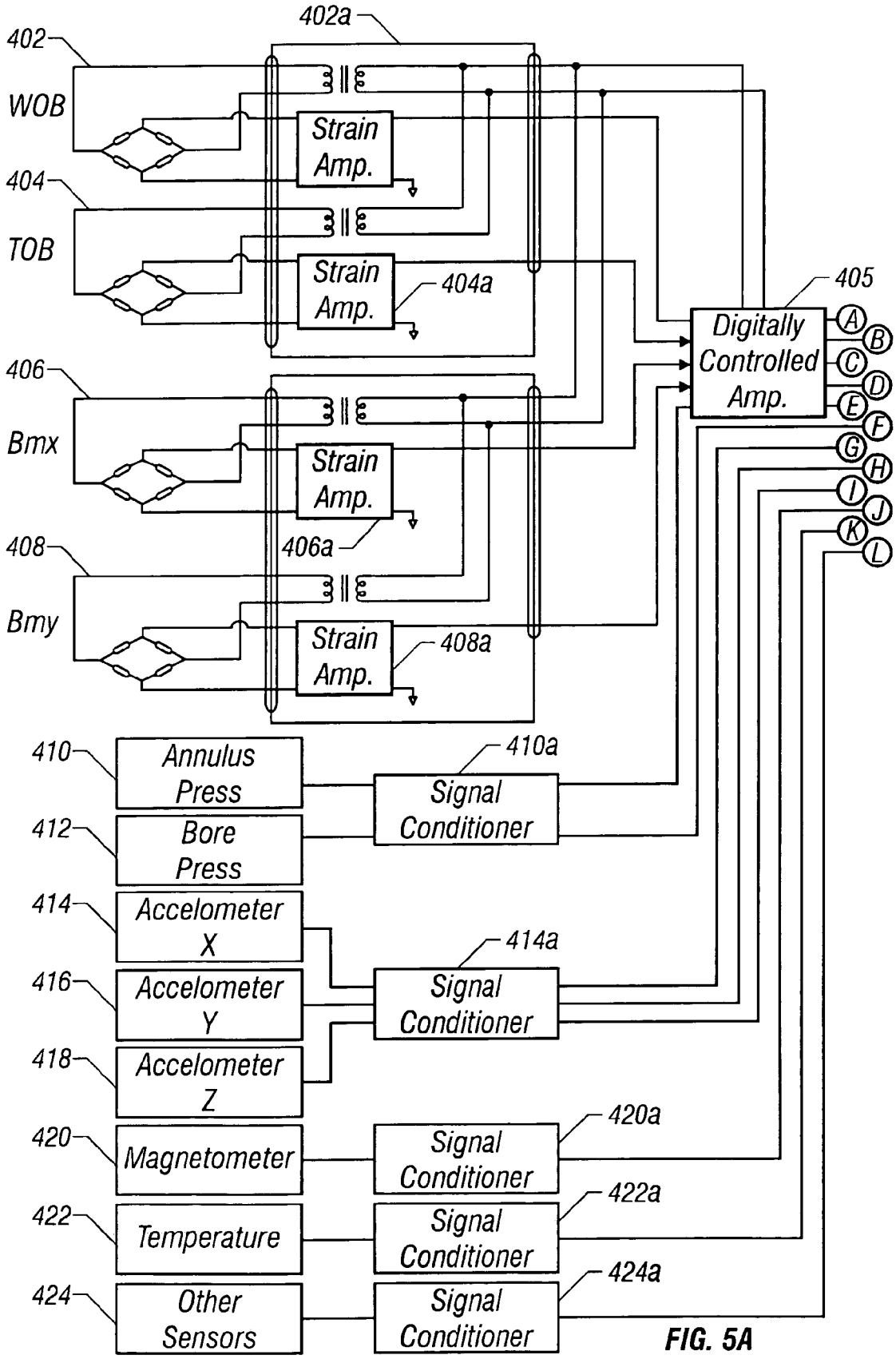
FIG. 5 shows a block circuit diagram for processing signals relating to certain downhole sensor signals for use in the bottomhole assembly used in the drilling system shown in FIG. 1.
Figure 5B:
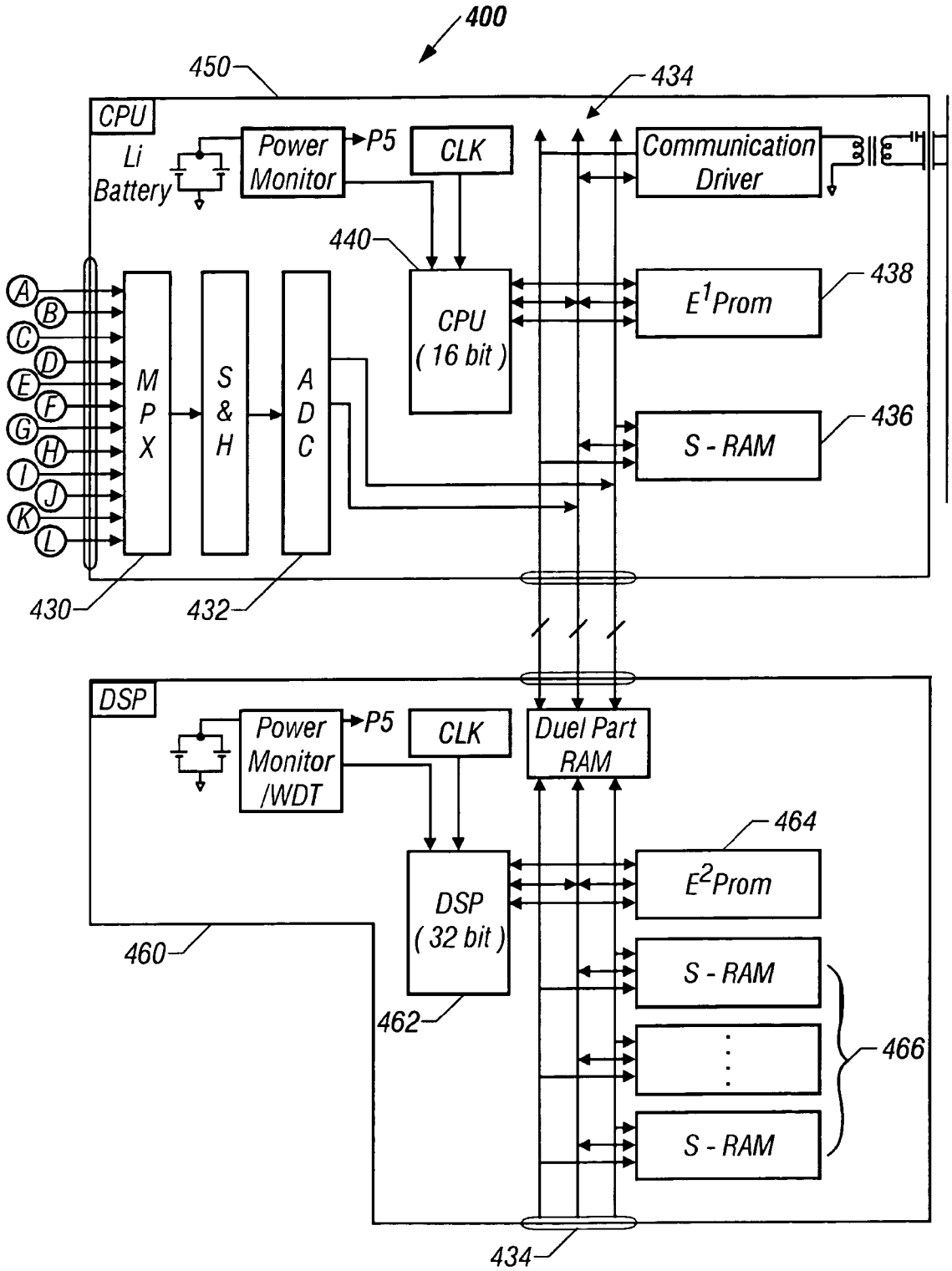

FIG. 5 shows a block circuit diagram for processing signals from the various sensors in the DDM device 59 (FIG. 1) and for telemetering the severity or the relative level of the associated drilling parameters computed according to programmed instructions stored downhole. As shown in FIG. 2, the analog signals relating to the WOB from the WOB sensor 402 (such as a strain gauge) and the torque-on-bit sensor 404 (such as a strain gauge) are amplified by their associated strain gauge amplifiers 402*a* and 404*a* and fed to a digitally-controlled amplifier 405 which digitizes the amplified analog signals and feeds the digitized signals to a multiplexer 430 of a CPU circuit 450. Similarly, signals from strain gauges 406 and 408 respectively relating to orthogonal bending moment components BMy and BMx are processed by their associated signal conditioners 406*a* and 408*a*, digitized by the digitally-controlled amplifier 405 and then fed to the multiplexer 430. While described herein as resistance strain gauges, any other type of suitable strain sensor may be used, such as optical strain sensors. Additionally, signals from borehole annulus pressure sensor 410 and drill string bore pressure sensor 412 are processed by an associated signal conditioner 410*a* and then fed to the multiplexer 430. Radial and axial accelerometer sensors 414, 416 and 418 provide signals relating to the BHA vibrations, which are processed by the signals conditioner 414*a* and fed to the multiplexer 430. Additionally, signals from magnetometer 420, temperature sensor 422 and other desired sensors 424, such as a sensor for measuring the differential pressure across the mud motor, are processed by their respective signal conditioner circuits 420*a*-420*c* and passed to the multiplexer 430.

The multiplexer 430 passes the various received signals in a predetermined order to an analog-to-digital converter (ADC) 432, which converts the received analog signals to digital signals and passes the digitized signals to a common data bus 434. The digitized sensor signals are temporarily stored in a suitable memory 436. A second memory 438, for example an erasable programmable read only memory (EPROM) stores algorithms and executable instructions for use by a central processing unit (CPU) 440. A digital signal processing circuit 460 (DSP circuit) coupled to the common data bus 434 performs majority of the mathematical calculations associated with the processing of the data associated with the sensors described in reference to FIG. 2. The DSP circuit includes a microprocessor for processing data, a memory 464, for example in the form of an EPROM, for storing instructions (program) for use by the microprocessor 462, and memory 466 for storing data for use by the microprocessor 462. The CPU 440 cooperates with the DSP circuit via the common bus 434, retrieves the stored data from the memory 436, processes such according to the programmed instructions in the memory 438 and transmits the processed signals to the surface control unit 40 via a communication driver 442 and the downhole telemetry 72 (FIG. 1).

Figure 6:
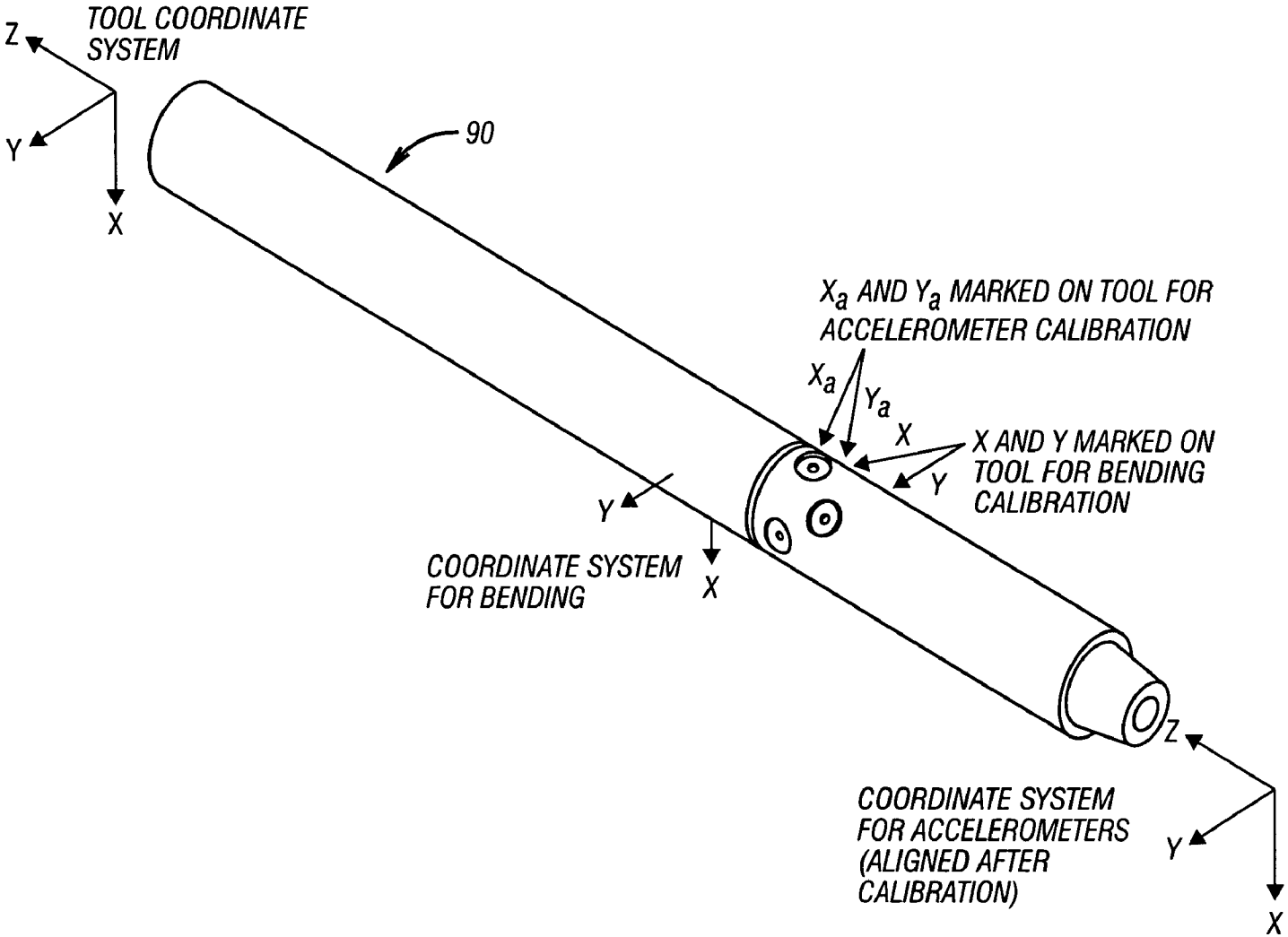
FIG. 6 depicts the coordinate system for bending sensors in the bottomhole assembly.

In one embodiment, measurement of the bending moment in BHA 90 (see FIG. 1) may be made at one or more positions along BHA 90, for example by inserting a sensor sub at each position in BHA 90 where such measurements are desired. At each position two independent measurements are performed in two perpendicular directions BMx and BMy where BMx and BMy are perpendicular to the BHA longitudinal axis. FIG. 6 depicts the tool coordinate system. Typically, a full strain gage measurement bridge (Wheatstone), such as that associated with bending measurements 406 and 408 in FIG. 5, is used with two gauges at opposite sides of the BHA for each individual axis. Each analog bending signal is converted independently from analog to digital for further processing. Additionally, measurements of gravity field (gx, gy) and magnetic field (Mx, My) are made with two perpendicular accelerometer sensors and two perpendicular magnetometer sensors with the sensor axes for bending, gravity and magnetic substantially aligned by design or by coordinate transformation to the same x-y coordinate system. Both bending moment amplitude and orientation in a rotating sensor sub may be calculated either as amplitude and angle with respect to high side (polar coordinates) or as vertical and azimuthal bending (Cartesian coordinates) from the BMx and BMy signals and the orientation sensors. Offset drift errors may be compensated for by rotating the tool at a fixed location such that each axis will see the same bending amplitude in both a positive and a negative signal in one rotation of the tool. If the signal amplitudes are not balanced about a zero value, the measurement channel may be exhibiting drift that may be compensated. In one example of such a measurement, 1. (Bx, By), (Gx, Gy) are parallel to (Mx, My). In other words the bending, gravity and magnetic measurement coordinate systems have substantially parallel axes.
2. N is the number of measurement bins per rotation of the tool. The angle measured by each bin is given by 360/N, and each bin extends from [n*360/N−180/N, n*360/N+180/N), where n=0, . . . , N−1.
3. The resulting image will be visually displayed using a gray scale over $2^m$ levels. For a default m=8, so a 0 to 255 gray scale image is generated.

Method at High Frequency Stage, i.e. at 100 Hz:

(a) calculate bending moment amplitude and phase at sample, k (b) calculate magnetic phase angle at sample, k. This phase angle is with reference to the far-field magnetic vector.
(c) calculate difference between magnetic and bending phases at sample, k. This then is the bending phase with respect to the far-field magnetic vector (call this bm phase).
(d) sum the calculated bending amplitude into the bin given by the bm phase
(e) calculate the cross-products required for the phase angle between gravity and magnetic tool faces Method at Low Frequency Stage. i.e. at 0.2 Hz
(1) gray scale the sums {normalize data, scale over $2^m$ levels}, save mean and standard deviation into 2×4-byte floats, thereby compressing 4*N bytes to N*(m/8)+8 bytes. This is the dynamic row image, but the static image can be recovered using the normalization parameters.
(2) calculate the angle between the magnetic and gravity tool faces
(3) rotate the row of the in the N bins by an amount equal to the angle between the gravity and tool faces. The image is now oriented with respect to gravity high side.
(4) output bending moment amplitude and orientation For each bending moment measurement point in BHA 90 (rotating or non-rotating) both the amplitude and the orientation of the bending moment are available for further processing downhole and, after transmission, at the surface.

A mathematical model (either a closed form analytical model or a numerical Finite-Element-Model) may be used to determine hole curvature ( indicated as dogleg severity) from the measured bending moment. It should be noted that the curvature is in three dimensional space and may be indicated as a magnitude and direction. With known orientation of the bending moment, both build-rate (deviation in the vertical plane) and walk-rate (deviation in the horizontal plane) can be calculated. The following describes this procedure.

Application of Bending Moment Measurement:

Dog Leg Severity from Bending Moment Measurement:

Bending moment measurement from downhole data can be easily converted into units of hole/tool dogleg severities (DLS) at the measurement location on the BHA as follows:

Using the well known relation $$\frac{M}{I} = \frac{E}{R} = \frac{\sigma}{y} \tag{1}$$

Where M represents the combined bending moment, I the moment of inertia of the BHA, R the radius of curvature, E the Young's modulus, y is the distance of the sensor from a neutral axis of the tool and σ the stress at the bending sensors. Therefore from equation (1)

$$\frac{1}{R} = \frac{M}{EI} \text{ and} \tag{2}$$

$$\frac{1}{R} = \frac{\sigma}{Ey} = \frac{\varepsilon}{y} \tag{3}$$

Where ϵ represents the strain at the sensors. The term EI in equation 2 is called "bending stiffness."

Using equation 2: Consider a bottom hole assembly drilling in a curved borehole. Therefore, any changes in the inclination and azimuth, caused by changes in WOB, RPM, formation etc, while drilling, results in a change in the borehole curvature. As a result of curvature change a corresponding change in collar bending moment occurs, which can be detected by the bending sensors mounted on the collar. Also since the curvature changes in the collar, occur as a result of inclination and azimuth changes, these changes can be detected by accelerometers and magnetometers in the collar, previously described, from which inclination and azimuth of the collar can be determined. Therefore, assuming that the collar in the BHA containing the sensor bends with a radius of curvature of R. The change in angle δ over a collar length of 100 feet is therefore given by:

$$\delta = \frac{100}{R} \tag{4}$$

Therefore, on substituting in equation (2)

$$\delta = \frac{100\ \mathrm{M}}{EI} \tag{5}$$

Where, the change in angle δ, defined above in radians/100 ft, is known as the 'dog leg severity' and is commonly given in the units of deg/100 feet (or deg/30 meter) when multiplied by the conversion factor $$\frac{180}{\pi}.$$

The moment of inertia I and bending moment M in equation (5) are given by $$I = \frac{\pi}{64}(d_o^4 - d_i^4) \text{ and} \tag{6}$$

$$M = \sqrt{M_x^2 + M_y^2} \tag{7}$$

Where $M_x$ and $M_y$ represent the X & Y bending moments and $d_o$ and $d_i$ represent the collar outside and inside diameters.

Alternatively, it may be assumed that strain ϵ is measured at a depth of y feet from the neutral axis of the tool. Then $$\delta = \frac{100}{R} = \frac{100\varepsilon}{y} \tag{8}$$

This provides an alternative way of computing DLS.

A plot of δ with time (or depth) from equation (5) will look similar to the bending moment curve but will be in units of dogleg severity (degrees/100 ft), which is more practical in terms of the tool health. Different tool sizes are accounted for in the MI calculations.

(ii) Azimuth Change Using Known Inclination Data from Directional Measurements and the Bending Moment Data from Bending Measurements:

If β represent the overall change in angle in the well bore between two survey stations, located at (i−1) and i locations, where, β is a function of inclination and azimuth change, then β can then be expressed in terms of dogleg severity δ (in degrees/100 ft) or bending moment (M) by the relations:

$$\beta=\cos^{-1}(\cos\Delta\epsilon\sin\alpha_i\sin\alpha_{i-1}+\cos\alpha_i\cos\alpha_{i-1}) \quad (9)$$

β is related to dogleg severity δ ( in degrees/100 ft ) by the following relationship $$\delta=\frac{\beta\cdot 100}{(l_i-l_{i-1})} \text{ therefore,} \quad (10)$$

$$\beta=\frac{M(l_i-l_{i-1})}{EI} \quad (11)$$

$l_i$, $l_{i-1}$ and $\alpha_i$, $\alpha_{i-1}$ represent the depths and inclination at the i and i−1 locations. Sin β can be computed from bending moment data using equation (11), the change in azimuth Δϵ can be estimated from equation (9):

$$\Delta\varepsilon=\cos^{-1}\left(\frac{\cos\beta-\cos\alpha_i\cos\alpha_{i-1}}{\sin\alpha_i\sin\alpha_{i-1}}\right) \quad (12)$$

Thus knowing azimuth at the initial location (i=0), the azimuth at successive locations can be easily determined using equation (12).

The walk rate $w_r$ of the BHA (in degrees/100 ft ) is therefore given by $$w_r=\frac{\Delta\varepsilon\cdot 100}{l_i-l_{i-1}} \quad (13)$$

It may be noted that in equation 12, the expression inside the brackets must have values between −1 and +1. It is possible that in case of errors in measurement of M, for example due to sudden impacts, the absolute value of Δϵ may be slightly greater than 1 and as such it cannot be evaluated at those locations, unless the value is made equal to 1.

The tool face angle γ can be calculated using the formula $$\gamma=\cos^{-1}\left(\frac{\cos\alpha_{i-1}\cos\beta-\cos\alpha_i}{\sin\alpha_{i-1}\sin\beta}\right) \quad (14)$$

Where β is the overall angle change from equation 10.

Figure 7:
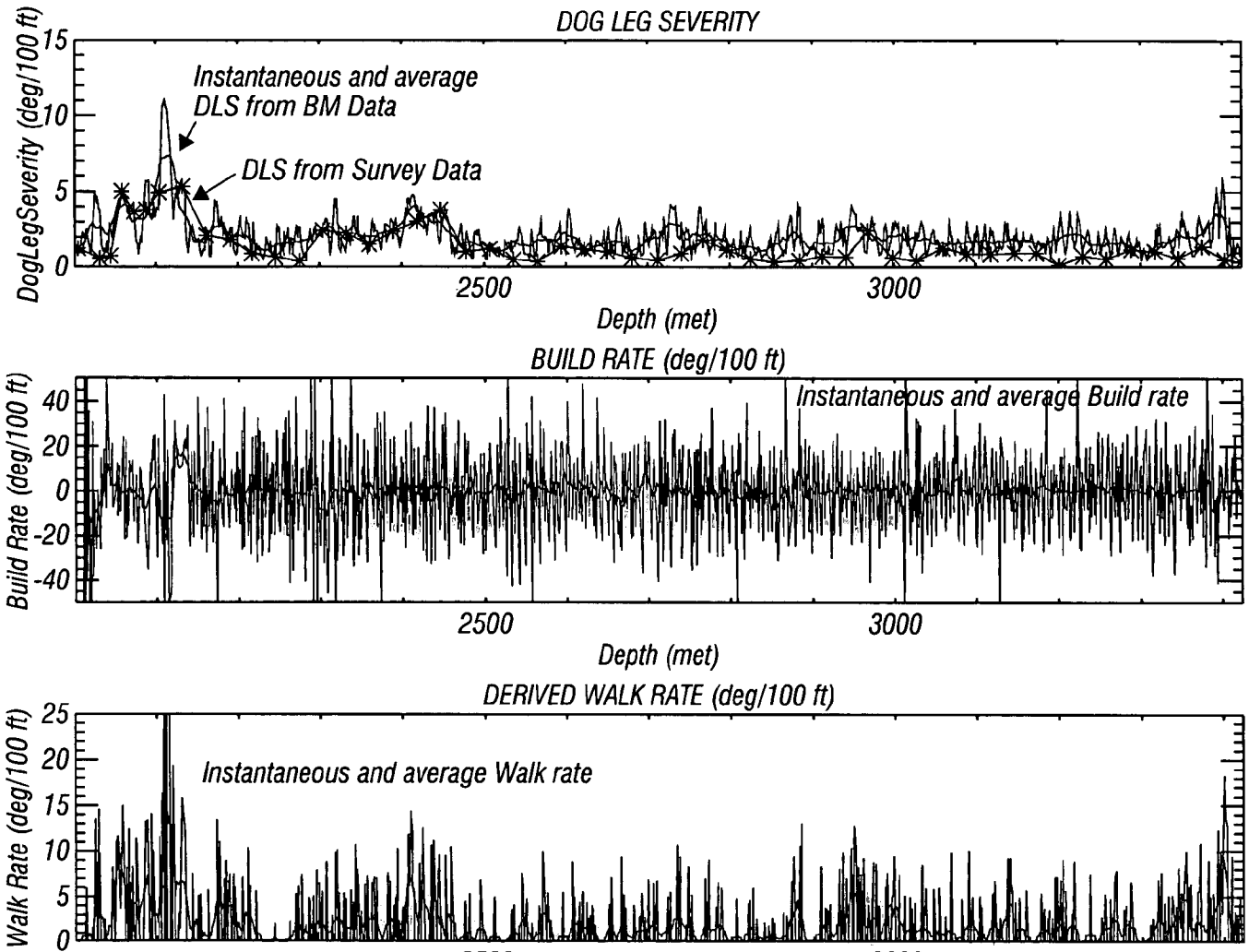
FIG. 7 shows the instantaneous 601 and averaged 602 DLS calculated from BM measurements as compared to the calculated 603 DLS using survey data.

As examples, real-time bending moment (BM) measurements from field data from multiple locations were post processed using the methods described herein. FIG. 7 shows the instantaneous 601 and averaged 602 DLS calculated from BM measurements as compared to the calculated 603 DLS using survey data.

Figure 8:
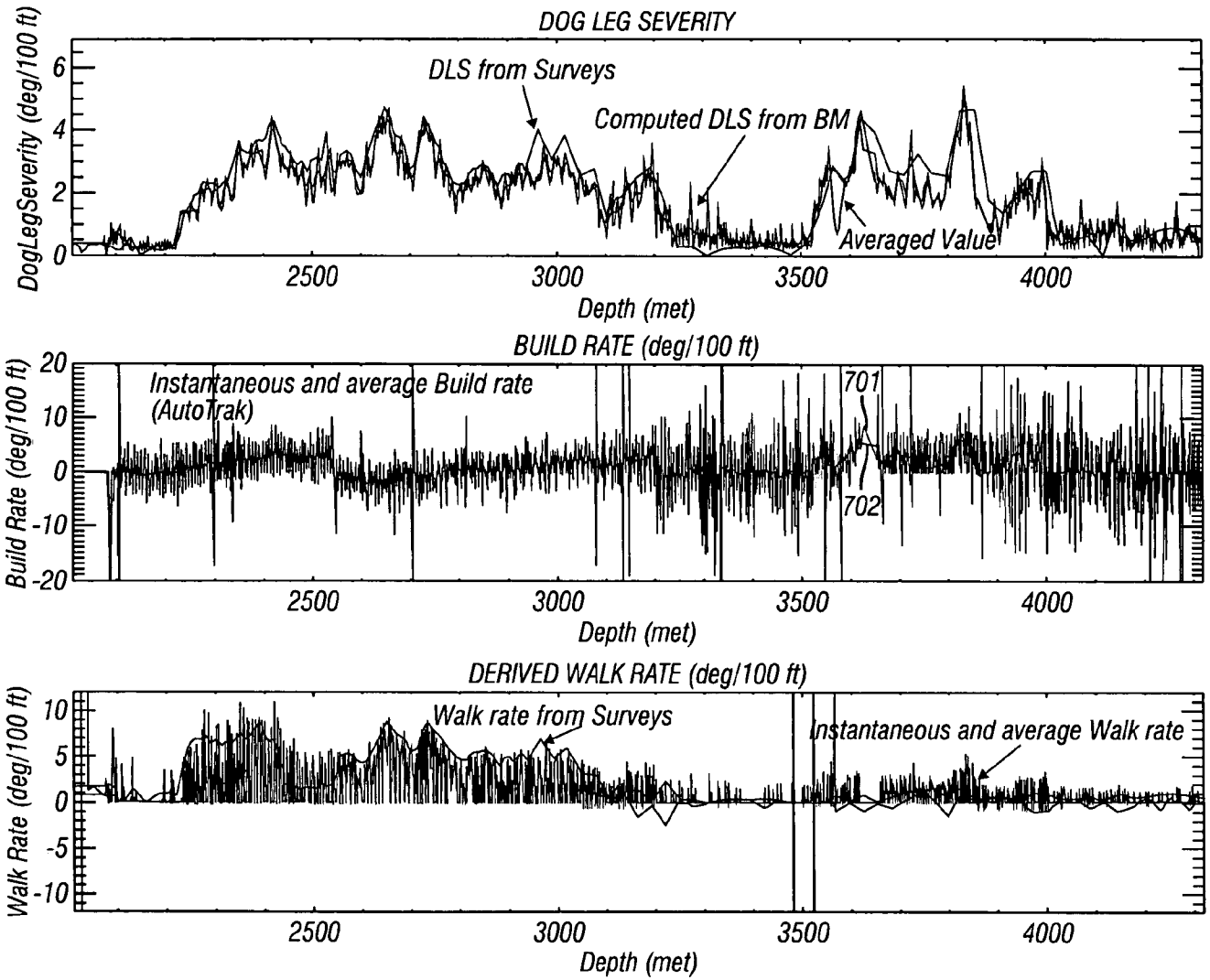
FIG. 8 shows the instantaneous 701 and averaged 702 build rate using inclination data.

FIG. 8 shows the instantaneous 701 and averaged 702 build rate using inclination data.

Figure 9:
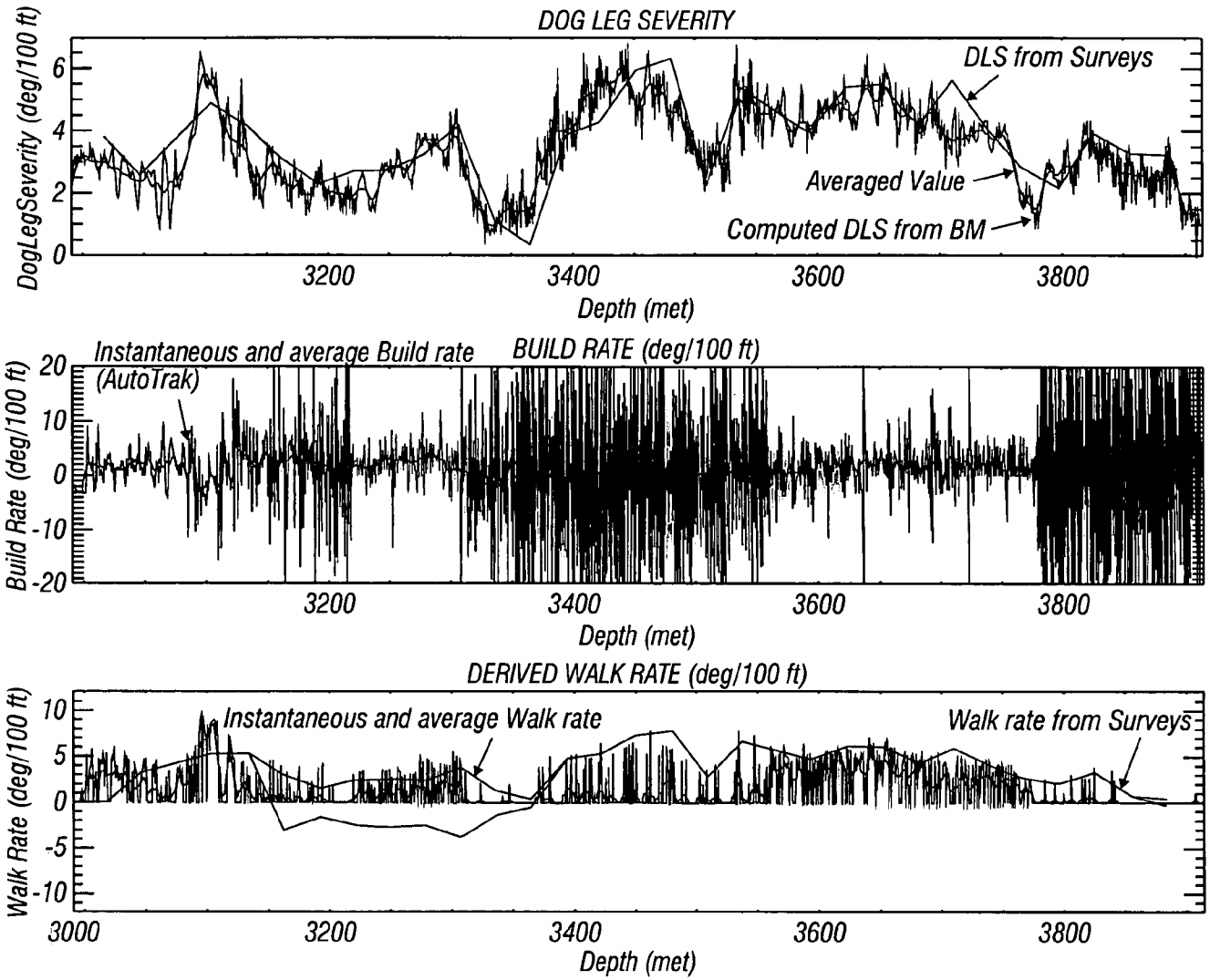
FIG. 9 shows the instantaneous and averaged walk rate using equation 12 compared to the calculated walk rate from survey data.
Figure 10:
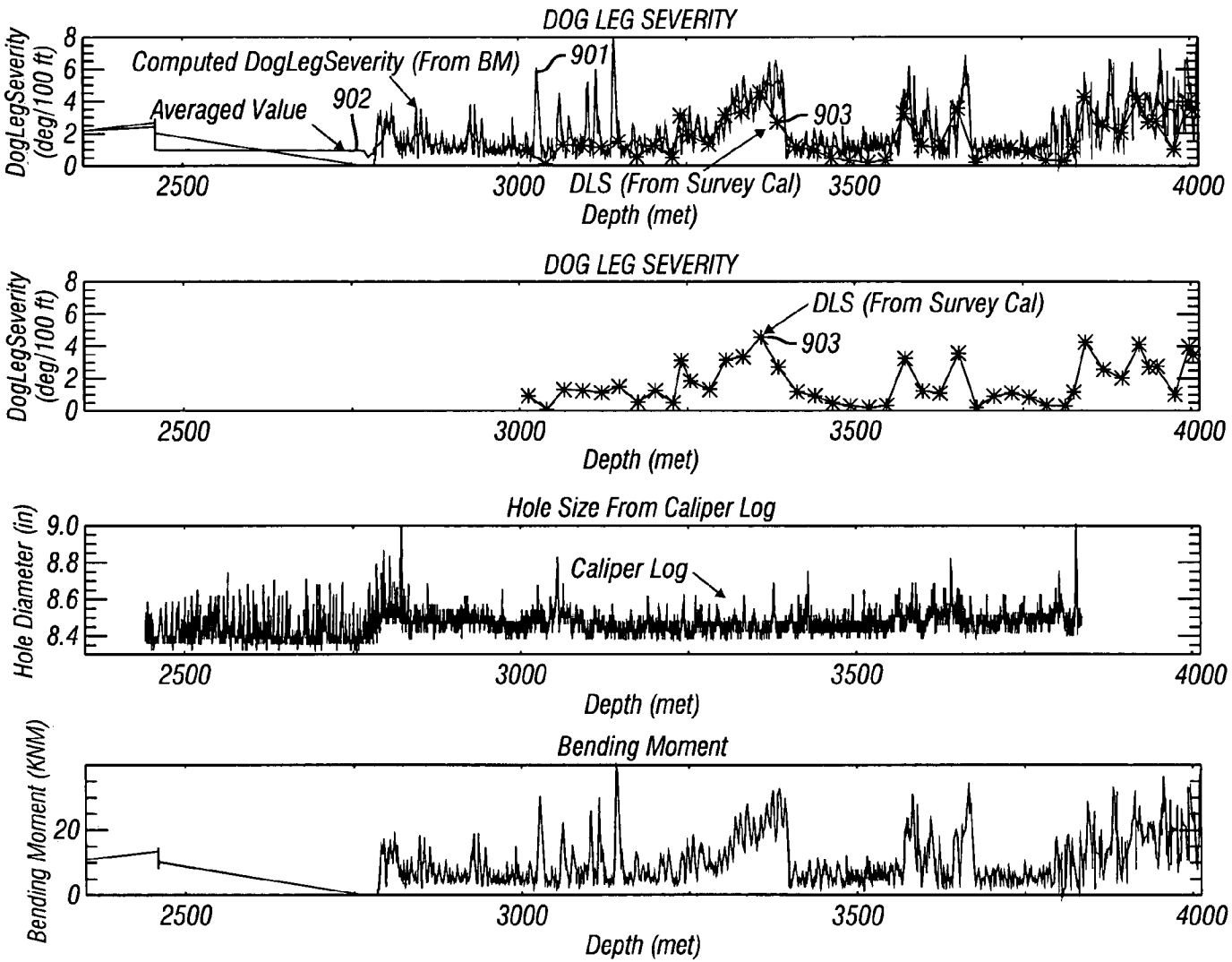
FIG. 10 shows the instantaneous 901 and averaged 902 DLS calculated from BM measurements as compared to the calculated 903 DLS using survey data.

FIG. 9 shows the instantaneous and averaged walk rate using equation 12 compared to the calculated walk rate from survey data FIG. 10 shows the instantaneous 901 and averaged 902 DLS calculated from BM measurements as compared to the calculated 903 DLS using survey data.

As indicated by FIGS. 7-10, the downhole bending moment data in conjunction with an appropriate bending model of the BHA, provide substantially higher resolution wellbore curvature information than that provided by the common standard curvature method that assumes a constant dogleg severity between successive survey stations. The method described provides an earlier feedback on directional changes than the driller would get from survey data at the end of each stand.

Application of Bending Moment Data to Improve Directional Accuracy

The measured bending moment data depends on the deformation of the Bottom Hole Assembly under the influence of gravity, weight on bit, steering forces and other side forces due to wall contacts and dynamic effects. As a result of this deformation, a directional sensor in the BHA typically centered on and parallel to the BHA axis will experience a misalignment to the borehole axis. In a 3D well profile this misalignment can happen both in the vertical plane (sag) as well as in the horizontal plane. These misalignment errors would result in an error in the placement of the well. Using bending moment data to compensate for misalignment error, a mathematical model can be used to describe the elastic deformation of the BHA and the direction of the already drilled hole (survey data and caliper if available). In this calculation the available bending moment measurements are extremely useful to limit the uncertainty involved in these mathematical models. The downhole information about both bending moment amplitude and orientation with respect to either gravitational high side or magnetic North in combination with the mathematical model, either downhole or at the surface, can provide continuous information about azimuth and inclination while drilling.

The combination of measured bending moment data and a mathematical BHA model provide information about the curvature (build rate and walk rate) of the wellbore. In combination with devices to change well path direction such as steerable motors or adjustable stabilizers, as discussed previously, the bending moment data can be used to control the hole curvature by changing the settings of the steerable devices. This can either be done in a surface loop involving personnel or computers at the surface or downhole in a controller in a closed control loop. As a practical example, both amplitude and direction of the steering force in a self-controlled directional system could be adjusted in order to reach and maintain target values for the bending moment in both amplitude and orientation.

As one skilled in the art will appreciate, directional sensors including magnetometers are commonly housed in a non-magnetic section of the BHA, such as a non-magnetic drill collar. Due to the requirements for spacing within a non-magnetic section of the BHA, the directional sensors providing the Azimuth of a wellbore are typically located a certain distance above the bit. As such, each directional measurement does not provide the direction of the hole being drilled at the bit but the direction of the borehole at the sensor location. The measurement of the bending moment amplitude and orientation with respect to high side (either gravity or magnetic) at one or more positions between the directional measurement point and the bit can be used to infer the wellpath direction from the point of the directional measurement to the bit position. Again a mathematical model is required to take the elastic deformation of the BHA into account. Information about steering history and hole caliper data can further increase the accuracy of the prediction. Such a model may be incorporated in a downhole closed loop system or, alternatively, the data may be transmitted to the surface for processing in a surface computer.

While the foregoing disclosure is directed to the preferred embodiments of the invention, various modifications will be apparent to those skilled in the art. It is intended that all variations of the appended claims be embraced by the foregoing disclosure.

What is claimed is:

1. A method for drilling a wellbore, comprising:

extending a bottomhole assembly into the wellbore;

measuring a bending moment M at at least one axial location along the bottomhole assembly; and estimating a dog leg severity of the wellbore using $$\delta=(k\times M)/(E\times I),$$

where M is the measured bending moment, E is the Young's modulus for the bottomhole assembly, I is the moment of inertia of the bottomhole assembly, and k is a conversion factor.

2. The method of claim 1 further comprising controlling the dog leg severity of the wellhole according to a predetermined target value.

3. The method of claim 1 further comprising controlling the bending moment measurements at a target magnitudes and orientation of the bottomhole assembly to drill the wellhole along a target path.

4. The method of claim 1 further comprising estimating a curvature of the wellbore at a drill bit disposed at the bottom of the bottomhole assembly using bending moment measurement and a directional measurement at a location along the bottomhole assembly spaced apart from the drill bit.

5. The method of claim 1, wherein measuring the bending moments comprises measuring the bending moment in two substantially orthogonal directions at the same axial location of the bottomhole assembly.

6. The method of claim 1 further comprising transmitting the bending moment measurement to a surface location for processing.

7. The method of claim 1 further comprising at least partially processing the bending moment measurement downhole.

8. The method of claim 1 further comprising estimating a bottomhole assembly misalignment in the wellbore at a directional measurement location using the bending moment measurement.

9. The method of claim 1 further comprising controlling a build rate of the wellbore using the bending moment measurement.

10. The method of claim 1 further comprising controlling a walk rate of the wellbore using the bending moment measurement.

11. The method of claim 1 further comprising estimating the dog leg severity of the wellbore at successive depths along the wellbore and using the estimated dog leg severity to alter a drilling parameter to control the dog leg severity at each such depth.

12. A system for drilling a wellbore, comprising:

a first sensor disposed in a bottomhole assembly at a predetermined axial location configured to measure a bending moment in a first axis substantially orthogonal to a longitudinal axis of the bottomhole assembly;

a second sensor disposed in the bottomhole assembly at the predetermined axial location configured to measure a bending moment in a second axis substantially orthogonal to the longitudinal axis; and a processor configured to compute therefrom a dog leg severity of the wellbore using:

$$\delta=(k\times M)/(E\times I);$$

where M is a bending moment obtaining from the bending moment in the first axis and the bending moment in the second axis. E is the Young's modulus for the bottomhole assembly, I is the moment of inertia of the bottomhole assembly, and k is a conversion factor.

13. The system of claim 12, wherein the first sensor and the second sensor are both strain gauges.

14. The system of claim 13, wherein the strain gauges are chosen from the group consisting of (i) resistance strain gauges and (ii) optical strain gauges.

15. The system of claim 12 further comprising a steerable device disposed in the bottomhole assembly, the steerable device configured to act cooperatively with the processor to control curvature of the wellbore.

16. The system of claim 15, wherein the steerable device is chosen from the group consisting of: (i) a downhole motor and (ii) an adjustable stabilizer.

17. The system of claim 12, wherein the processor is at least partially located downhole.

18. The system of claim 12, wherein the processor is located at a surface location.

19. The system of claim 12 further comprising a directional sensor comfigured to obtain a measurement indicative of the path of the wellbore.

20. The system of claim 19, wherein the directional sensor comprises one of: (i) a magnetometer, (ii) an accelerometer, and (iii) a gyro device.

21. The system of claim 12, wherein the first axis and the second axis are substantially orthogonal to each other.

* * * * *